United States Patent [19]

Tseng

[11] 4,279,265

[45] Jul. 21, 1981

[54] UMBRELLA

[76] Inventor: An-Teh Tseng, 188, Tungmen St., Hsinchu City, Taiwan

[21] Appl. No.: 138,155

[22] Filed: Apr. 7, 1980

[30] Foreign Application Priority Data

[TW] Taiwan .....

[51] Int. Cl.[3] ..... A45B 25/28

[52] U.S. Cl. ..... 135/48; 135/20 R; 135/16; 135/24

[58] Field of Search ..... 135/48, 16, 20, 24

[56] References Cited

U.S. PATENT DOCUMENTS

| | | | |
|---|---|---|---|
| Re. 5,215 | 12/1872 | Winter et al. | 135/48 |
| 110,452 | 12/1870 | Fowler | 135/48 |
| 188,857 | 3/1877 | Clay | 135/48 |
| 288,889 | 11/1883 | Susman | 135/48 |
| 337,145 | 3/1886 | Ghezzi | 135/48 |
| 688,145 | 12/1901 | Winter | 135/48 |
| 2,838,058 | 6/1958 | Foltis et al. | 135/48 |

FOREIGN PATENT DOCUMENTS

| | | | |
|---|---|---|---|
| 543647 | 6/1922 | France | 135/48 |

*Primary Examiner*—J. Karl Bell

[57] ABSTRACT

An umbrella comprises a flexible water collecting device and a self-supporting device both provided generally within the upper portion of a stick member and controlled by a controlling device. When one releases the controlling device, the water collecting device and the supporting device will protrude out of the stick member a certain length by a spring mounted in a handle. The water collecting device can automatically open to form a small umbrella upon protruding out of the stick member.

6 Claims, 4 Drawing Figures

UMBRELLA

BACKGROUND OF THE INVENTION

1. Field of the Invention

This invention relates to an umbrella having a water collecting device and a supporting device both provided generally within one end of a stick member thereof.

2. Description of the Prior Art

Most conventional umbrellas have a number of disadvantages, for instances, rain drops remained on the screen of the umbrella will flow downwardly to wet the floor when the umbrellas are kept in a closed condition, and there is no self-supporting device provided thereon so that the conventional umbrellas can not stand independently.

SUMMARY OF THE INVENTION

In accordance with the invention an umbrella comprises a flexible water collecting device which is generally positioned within one end of a stick member of the umbrella, a supporting device which is also generally positioned at the end of the stick member and slidable on the water collecting device, connecting means extending through the stick member and into an handle thereof to contact against a spring which is generally compressed in the handle, and a controlling device mounted on the handle for controlling the compressed spring to push the connecting means to move upwardly so as to make the water collecting device and the supporting device extend through and protrude out of the end of the stick member. The water collecting device will keep automatically in an open condition upon protruding out of the stick member. Thus, when the umbrella, according to the present invention, is supported invertedly by the supporting device, rain drops remained on the screen of the umbrella will flow into the water collecting device without any leakage.

Accordingly, it is an important object of the present invention to provide an umbrella including a water collecting device so as to avoid wetting the floor, in other words, rain drops remained on the screen of the umbrella will flow into the water collecting device when the umbrella is positioned invertedly.

It is another main object of the present invention to provide an umbrella having a self-supporting device which can make the umbrella stand independently.

These and other desirable objects are accomplished by the construction disclosed as an illustrative embodiment of the invention in the following description and in the accompanying drawings forming a part hereof, in which:

DETAILED DESCRIPTION OF A PREFERRED EMBODIMENT OF THE INVENTION

Figure 1:
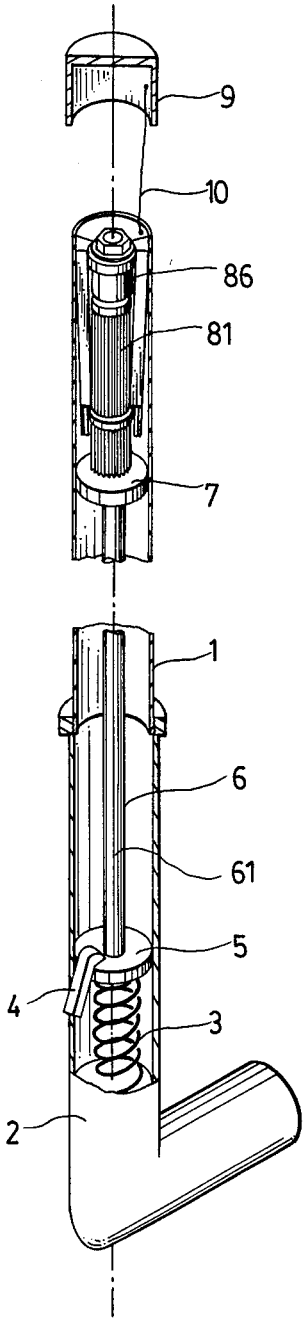
FIG. 1 is a fragmentary perspective view of an umbrella according to the present invention illustrating the position of a water collecting device and a supporting device within a stick member without showing ribs, screen, runner and other known members.
Figure 2:
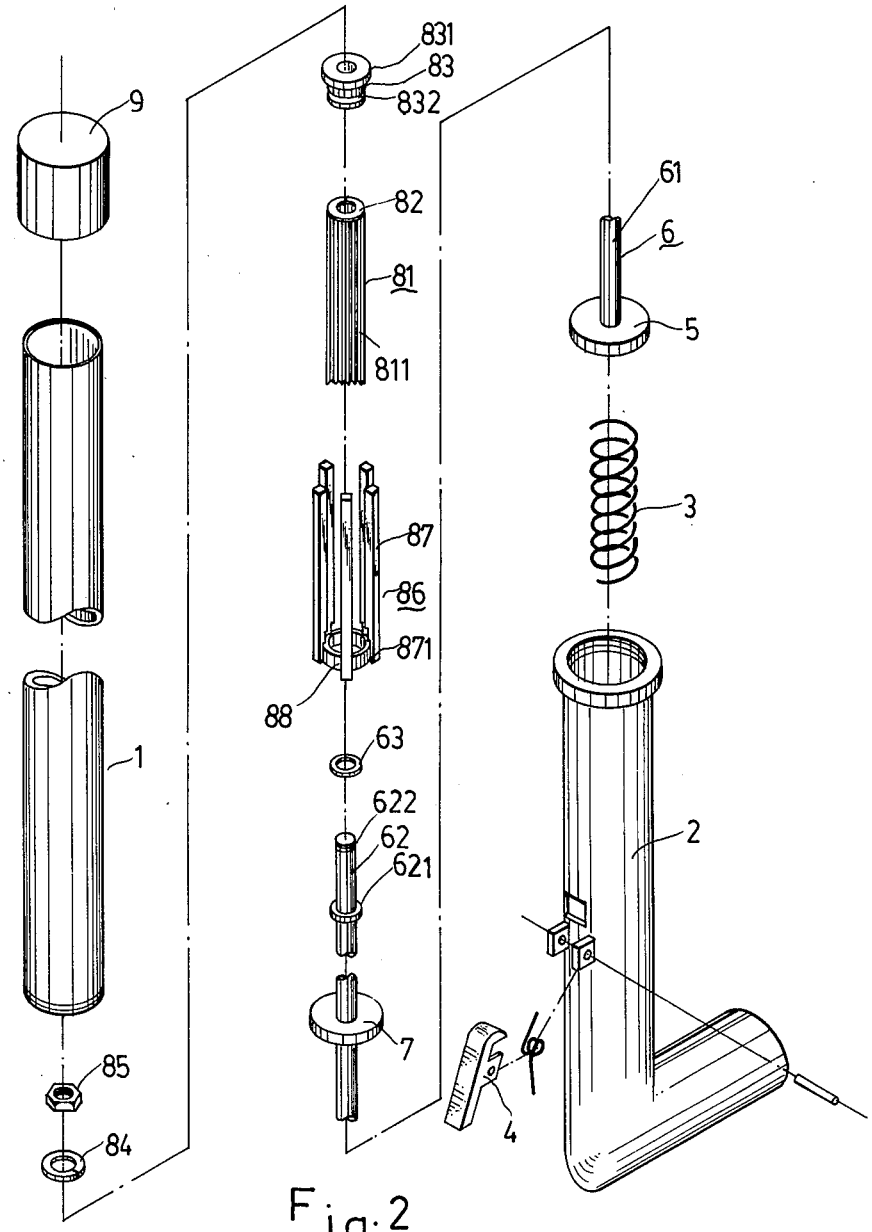
FIG. 2 is an exploded perspective view of the umbrella as shown in FIG. 1.

Referring now to the drawings, and more particularly to FIGS. 1 and 2, there is shown a preferred embodiment of the present invention in which screen, ribs and other known members of the umbrella are not shown. Numeral 1 designates a stick member having a water collecting device 81, a supporting device 86 and a part of a connecting device 6 therein. Numeral 2 designates a handle member having a spring 3 and a part of the connecting device 6. The connecting device 6 includes a connecting rod 61 which can extend through the whole length of the stick member 1, two circular plates 5, 7 of different size mounted on each end of the connecting rod 61 respectively. The circular plate 5 is placed in the handle 2 and contacted against the upper end of the spring 3 which is generally compressed and locked by a controlling device 4 mounted on the handle 2 on a normal position. Diameters of the circular plates 5, 7 are smaller than inner diameters of the handle 2 and of the stick member 1 respectively, so that the connecting device 6 is slidable within the stick member 1. However, the diameter of the circular plate 5 is larger than the inner diameter of the stick member 1 so that the lower end of the stick member 1 will act as a stop means for the circular plate 5. Mounted on the upper side of the circular plate 7 are the water collecting device 81 and the supporting device 86 which are generally positioned within the upper portion of the stick member 1. Consequently, when one pushs the controlling device 4 downwardly to release the spring 3, the circular plate 5 of the connecting device 6 will be moved unwardly by extension of the compressed spring 3 and terminated at the lower end of the stick member 1 so as to make the water collecting device 81 and the supporting device 86 protrude out and mount on the upper end of the stick member 1.

The water collecting device 81 includes a main rod 62 mounted on the upper side of the circular plate 7 and having a flange 621 surrounding the upper portion thereof, a resilient screen 811 made of flexible materials such as plastics, a rigid annular plate 82 mounted on a central opening of the screen 811, and a sleeve barrel 83 having a groove 832 surrounding the lower outer surface thereof and a flange 831 provided on the upper end thereof acting as a stop means.

The supporting device 86 comprises a ferrule 88, and a plurality of supporting legs 87 pivoted on the ferrule 88. The ferrule 88 is slidable on the sleeve barrel 83, thus, if some external force applies to it. The sliding of said ferrule 88 will terminate by the flange 831 of the sleeve barrel 83.

A movable cap 9 is generally positioned on the upper end of the stick member 1 when the water collecting device 81 and the supporting device 86 are positioned within the stick member 1. To match the protrusion of the water collecting device and the supporting device, the cap 9 will be moved away from the upper end of the stick member 1 and suspended by a string 10 which is connected to the upper end of the stick member 1 so as to avoid losing the cap 9.

In FIG. 2, it is clearly shown that the upper end of the main rod 62 is provided with external screw 622 thereon and extends through an annular packing 63, the annular plate 82 mounted on the screen 811, the sleeve barrel 83 and a washer 84 and further screwed by a nut 85. More specifically, the sleeve barrel 83 and the annular plate 82 are fixed to the flange 621 by the nut 85.

The screen 81 has a plurality of radial folding lines thereon whereby to reduce its expansion area to form a cylindrical cnfiguration so as to allow it to be placed in the stick member 1. On the other hand, the screen 81 opens automatically to form a small umbrella by its inherent expansion property when the water collecting device protrudes out of the stick member by the extension of the spring.

Figure 3A:
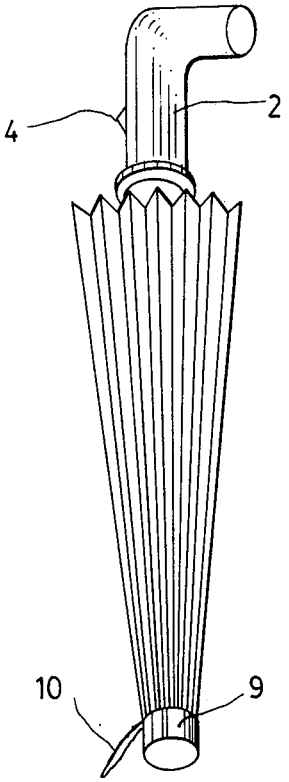
FIG. 3*a* is a perspective view of the umbrella according to the present invention when in a closed condition, the water collecting device and supporting device thereof not protruding therefrom.
Figure 3B:
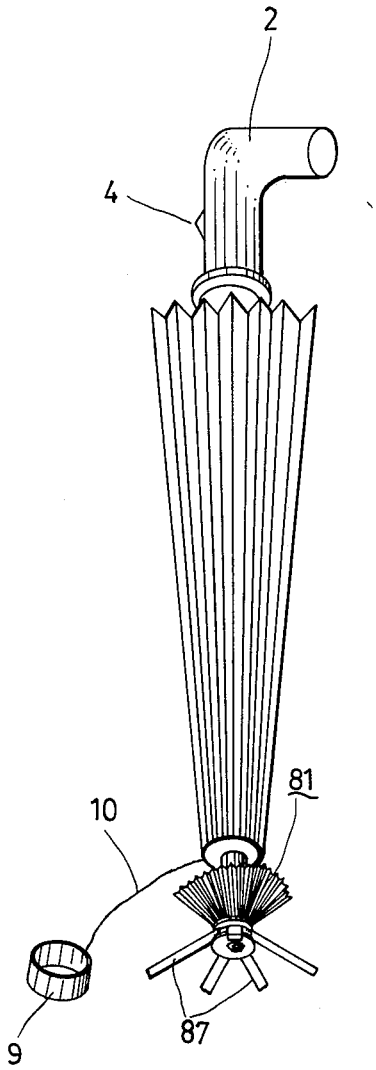
FIG. 3*b* is a perspective view of the umbrella as shown in FIG. 3*a* when in a closed condition with the water collecting device opened and supported by the supporting device.

After the protrusion of the water collecting device and the supporting device, one may open the supporting legs 87 to form a supporting stand as shown in FIG. 3*b* under such situation, pivoted end 871 of the supporting legs 87 is inserted into the groove 832 of the sleeve barrel 83. Thus, water drops remained on the screen will flow downwardly into the inverted small umbrella formed by the screen without any leakage. Since the controlling device 4 as shown in FIG. 2 is a known skill, it is not described hereinabove.

Obviously many modifications and variations of the present invention are possible in the light of the above teachings. It is therefore to be understood that within the scope of the appended claims, the invention may be practiced otherwise than as specifically described.

What is claimed is:

1. An umbrella comprises:

a handle having a generally compressed spring therein;

means mounted on said handle for controlling said spring;

a hollow stick member connected with said handle and having a movable cap provided at the top end thereof, and a supporting device mounted slidably on a water collecting device provided generally within the upper portion thereof;

movable connecting means for connecting said spring with said water collecting device, said water collecting device and said supporting device to protrude out of the top end of said stick member by extension of said spring when said spring is released by said means.

2. An umbrella as claimed in claim 1, wherein said water collecting device includes a main rod connected with one end of said connecting means and having a flange surrounding its upper portion and external screw provided on the upper end thereof; a flexible screen having an annular plate mounted on a central opening thereof for positioning it on said flange of said main rod; and a sleeve barrel having a through way therein, a groove surrounding the outer surface thereof and a flange provided at the upper end thereof so as to stop the sliding of said supporting device.

3. An umbrella as claimed in claim 2, wherein said supporting device includes a ferrule slidable on said sleeve barrel and a plurality of supporting legs pivoted on said ferrule, the pivoted end of each said supporting leg to be inserted into said groove of said sleeve barrel when it protrudes out of the stick member and opens to act as a supprting stand.

4. An umbrella as claimed in claim 2, wherein said water collecting device can automatically open to form a small umbrella when it protrudes out of said stick member.

5. An umbrella as claimed in claim 1, wherein said movable connecting means comprises a connecting rod extending through said stick member and into said handle, a first circular plate mounted on the lower end of said connecting rod and contacted against said spring within said handle, and a second circular plate mounted on the upper end of said connecting rod and positioned within said stick member, the diameter of said first circular plate being larger than the inner diameter of said stick member whereby the upward movement of said connecting means by extension of said spring will be terminated by the lower end of said stick member when said spring is released by said means.

6. An umbrella as claimed in claim 1, wherein a string is used to connect said cap with said stick member.

* * * * *